United States Patent [19]

Spodig

[11] 4,157,955

[45] Jun. 12, 1979

[54] MAGNETIC SEPARATOR

[76] Inventor: Heinrich Spodig, 4714 Selm-Bork, Netteberge 202, Fed. Rep. of Germany

[21] Appl. No.: 778,226

[22] Filed: Mar. 16, 1977

[30] Foreign Application Priority Data

Mar. 26, 1976 [DE] Fed. Rep. of Germany ..... 2612834

[51] Int. Cl.[2] ..... B03G 1/26

[52] U.S. Cl. ..... 209/219; 210/222

[58] Field of Search ..... 209/219, 232, 223 R, 209/223 A; 210/222, 223

[56] References Cited

U.S. PATENT DOCUMENTS

| | | | |
|---|---|---|---|
| 449,610 | 3/1891 | Moffatt | 209/223 A |
| 815,113 | 3/1906 | Odling | 209/223 R |
| 832,827 | 10/1906 | Wait | 209/219 |
| 1,068,453 | 7/1913 | Rowand | 209/219 |
| 1,958,521 | 5/1934 | Payne | 209/219 |
| 2,078,513 | 4/1937 | Stearns | 209/232 X |
| 3,948,766 | 4/1976 | Spodig | 209/219 |

FOREIGN PATENT DOCUMENTS

| | | | |
|---|---|---|---|
| 180916 | 7/1954 | Austria | 209/232 |
| 616859 | 4/1957 | Canada | 210/222 |
| 736332 | 9/1955 | United Kingdom | 209/232 |

*Primary Examiner*—Robert Halper

*Attorney, Agent, or Firm*—Wallenstein, Spangenberg, Hattis & Strampel

[57] ABSTRACT

Magnetic separators for cleaning liquid, pasty and dry materials by separating magnetic from non-magnetic substances contained in said materials, wherein means are provided to form a flow-through housing with at least one separation roll arranged therein which magnetically cooperates with an antipole, said separation roll, including a shaft on which it is mounted for rotation, and said antipole are mild iron parts of at least one magnetic system with a closed magnetic circuit.

12 Claims, 9 Drawing Figures

FIG.5
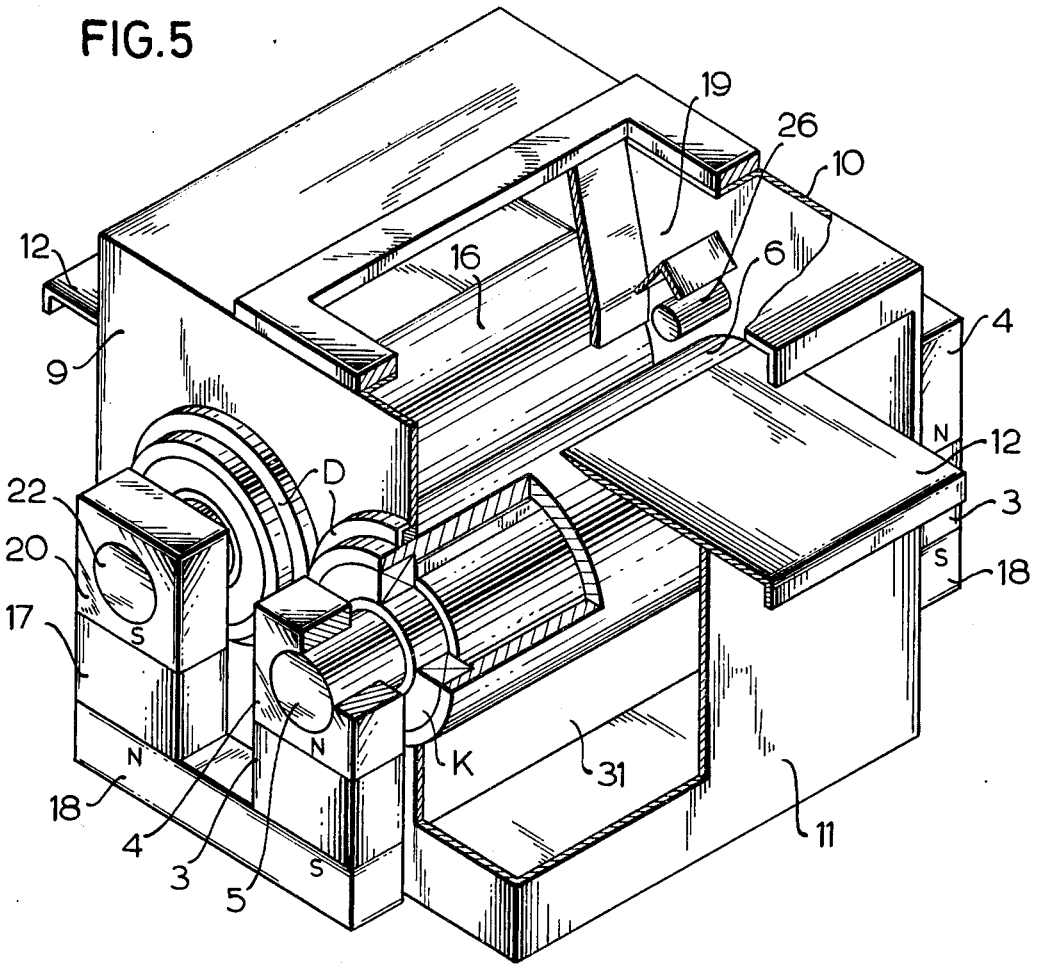
FIG.6
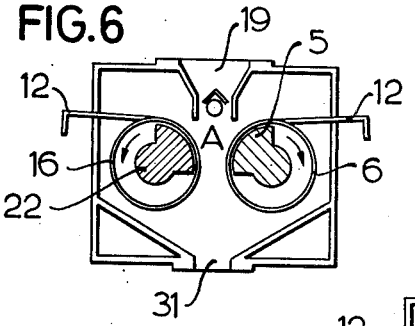
FIG.8
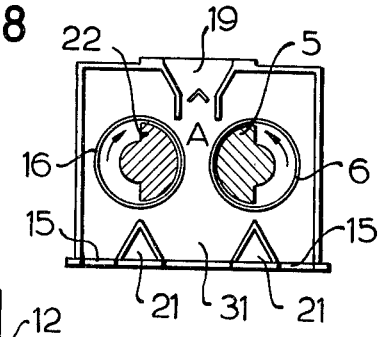
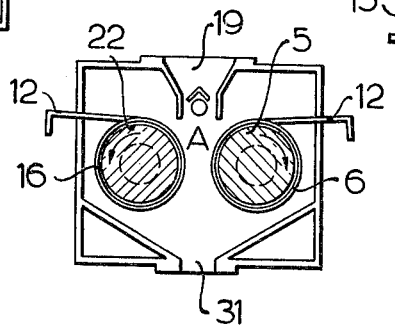
FIG.7

MAGNETIC SEPARATOR

This invention relates to improvements in magnetic separators, particularly for use in separating magnetic materials from non-magnetic materials from liquid, pasty and dry mixtures containing both magnetic and non-magnetic materials.

Magnetic separators have long been known to art and many patents have issued covering numerous types of constructions, all having as their primary objectives to effect a separation of magnetic materials or magnetic particles from liquids, pastes or solids, as the case may be in relation to a particular given construction. Illustrative of such magnetic separators is that shown in Austrian Pat. No. 180,916. In the magnetic separator of said Austrian patent, there is provided a stationary iron housing and an iron collecting and discharge roll or roller guiding the magnetism and arranged in the field of lines of force of a magnetic system whose total unit is formed by the housing and at least one permanent magnet body. The collecting and discharge roll is positioned to be magnetically insulated in the iron housing to avoid any magnetic short circuit which would render the magnetic system practically magnetically ineffective. In the magnetic separator of said patent, the magnetic system thereof contains two air gaps, one being located between the collecting and discharge roll and the corresponding opposite part of the housing. This air gap is at the same time the operating air gap through which the material to be separated passes and in which the magnetizable parts of the material to be separated are collected and discharged by the collecting and discharge roll. The other air gap is located in the said magnetic separator at the point where the permanent magnets and/or their pole shoes are located with the poles facing away from the housing ahead of the collecting and discharge roll, their task being that of polarizing the collecting and discharge roll. With this air gap located proximal to the separation area, it happens that it becomes encumbered with magnetizable impurities from the material to be separated. This causes disturbances, and sometimes even blockings, to the function of the magnetic separators, with the result that operational shutdowns occur not infrequently. Moreover, as is known, dissipation losses occur in air gaps, depending on their position relative to the magnets and on their size, which more or less weaken the magnetic field at the operating air gap, and thus exert an unfavorable influence on the effectiveness of the separating results. Moreover, and apart from said deficiencies of such separators, phenomena of demagnetization also occur in such and other magnetic separators which comprise a magnetic circuit interrupted by an operating air gap, and this contributes to a weakening of the magnetic output of the magnetic separators over a period of time of usage of such magnetic separators.

The present invention effectively overcomes the problems and deficiencies in magnetic separators of the general type described above and as illustrated by magnetic separators such as are shown in the aforesaid Austrian patent. In accordance with the invention of the present application, effective means are provided for concentrating the line of force on and in the operating air gap, whereby to keep the external leakage fields as low as possible and to avoid straying effects outside the effective area of the magnetic separator as far as is reasonably possible. In broad terms, this is achieved, in magnetic separators for the cleaning of liquid, pasty and dry material or, in other words, in separating magnetic from non-magnetic materials from mixtures thereof present in liquid, pasty and dry materials, through magnetic separator equipment which comprises a flow-through unit supported in a housing with at least one separator roll arranged therein which magnetically cooperates with an antipole, and wherein the separating roll, including its shaft and its antipole, are mild iron parts of or making up at least one magnetic system with a closed magnetic circuit.

The magnetic system forming a part of the magnetic separators of the present invention comprises one or several closed magnetic circuits, where the permanent magnets are located outside the flow-through housing and have a high demagnetization resistance due to the course maintaining the magnetic lines of flux stable in the closed magnetic circuit with a simultaneous high magnetic concentration of the lines of force in the operating air gap. This means that the magnetic separator is practically free from straying effects and is, thus, equipped with the most optimal magnetic field for the separation. Depending on the permanent magnetic material used and the soft magnetic iron types available with an iron induction of about 5000 to 6000 Gaus, practically complete saturation of the iron can be achieved at the operating air gap even with quite large gap widths.

The detailed features and advantages are explained more fully below in conjunction with the illustrative embodiments of the invention shown in the accompanying drawings wherein FIG. 1 is a perspective view, partly in section, showing a magnetic separator in accordance with the present invention, utilizing a separating roll and an antipole.

FIG. 5 shows a perspective view, partly in section, of a magnetic separator according to the present invention but utilizing two separation rolls.

FIGS. 6 and 7 are schematic presentations, partly in section, of the magnetic separator of FIG. 5, utilizing separating rolls of different designs.

FIG. 8 is a schematic presentation, partly in section, of the magnetic separator of FIGS. 5 and 9, designed particularly for dry separation.

Figure 1:
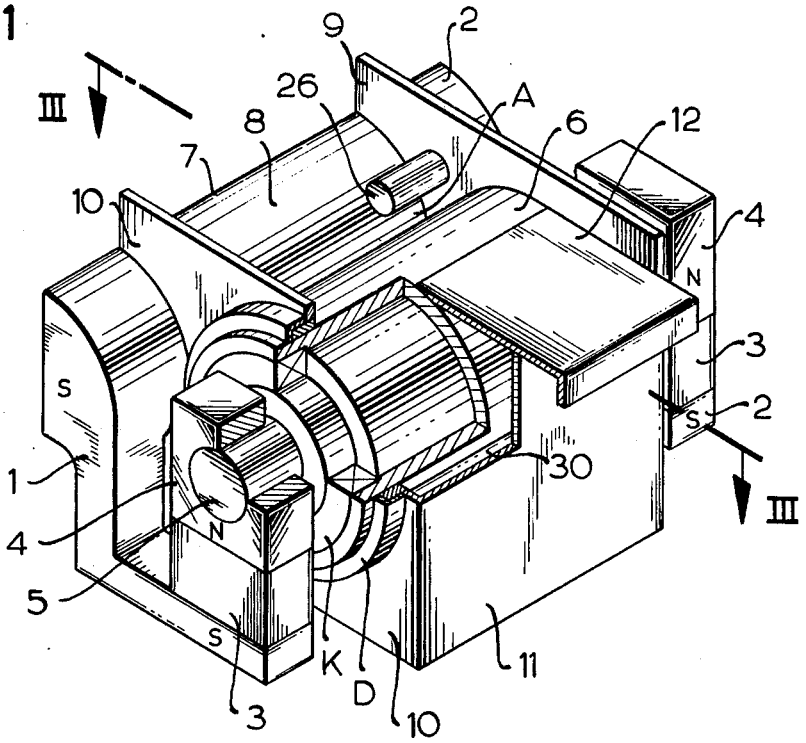
Figure 2:
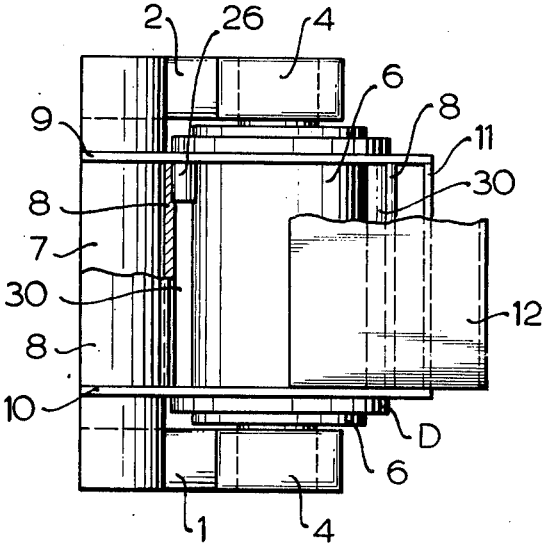
FIG. 2 is a schematic top view of FIG. 1.
Figure 3:
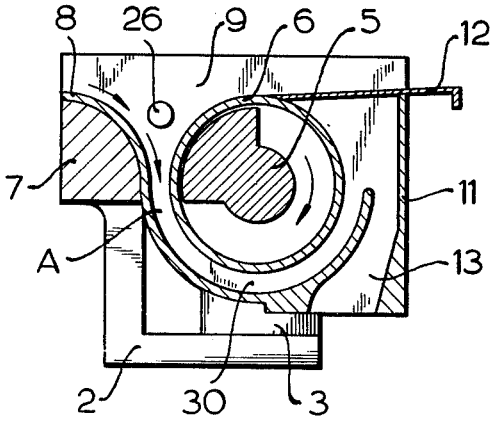
FIG. 3 is a sectional view taken along the line III—III of FIG. 1, looking in the direction of the arrows.

The magnetic separator, according to the invention, which utilizes a magnetic roll and an antipole of magnetically conductive material, such as iron, has, in the illustrative embodiment of FIG. 1, two rectangular angle irons 1,2 placed back to back and likewise made from a magnetically conductive material, with a block-shaped permanent magnet 3 each arranged on a horizontal leg, and a pole shoe 4 being mounted on the free pole end of each of said permanent magnets 3. The other or vertical legs of the angle irons 1,2 are acuately curved at the general level of the pole shoes 4 and toward the side.

The permanent magnets 3 have the same direction of magnetization, so that the pole shoes 4 have an N-polarity and the vertical legs of the angle irons 1 have a South-polarity. The magnetically conductive shaft 5 of the drum-shaped separation roll 6 is positioned in the pole shoes 4. The drum-shaped separation roll 6 rotates on ball bearings K which are pulled up on the shaft 5. Thus, the shaft 5 connects both pole shoes 4 over a certain distance with each other. At the same distance the free ends of the vertical legs of the angle irons 1,2 at the level of their curvature are connected to a magnetically conductive bridge 7 as an antipole to the shaft 5. As a result of these connections 5,7, a closed magnetic circuit is produced which extends continuously in each case from the one magnetic pole to the other one whereby the drum-shaped separation roll 6 is provided via the shaft 5 with the one polarity (N) and via bridge 7 with the opposite polarity (S). Thereby, the magnetic operating air gap A is located between the bridge 7 and the separation roll 6. For the practical utilization of the operating air gap A, particularly for the separation of liquid materials, a non-magnetic vat 8 is inserted into the interstice between the angle irons 1,2 which adheres to the bridge 7 and for the remainder it embraces the separation roll 6 from the side of the bridge 7 as far as the opposite side, in fact approximately as far as half the height to form a flow-through channel 30 for the material to be separated with said distance. At its sides placed transversely to the flow-through channel 30 and at the discharge side of the collected material to be separated, the vat 8 is sealed by non-magnetic panels 9,10,11 and cooperating therewith for tight sealing is a sealing ring D. A conventional stripping member or panel 12 is placed on the panel 11 and on the separation roll 6. The liquid to be separated enters the vat 8 at the side of the bridge 7, passes through the flow-through channel 30 and leaves the vat 8 at 13, magnetically purified. The separation takes place in the gap A, where the opposite poles, the separation roll 6 polarized by the segment-shaped shaft 5 and the bridge and most proximally opposite each other. Here the magnetic field, which is completely closed except for the gap A, is practically homogeneous, while in the flow-through direction of the material to be separated it gradually weakens and becomes non-homogeneous. The material collected by the separation roll 6 is dicharged in the direction of rotation indicated by the arrow, and stripped by the stripper 12.

Figure 4:
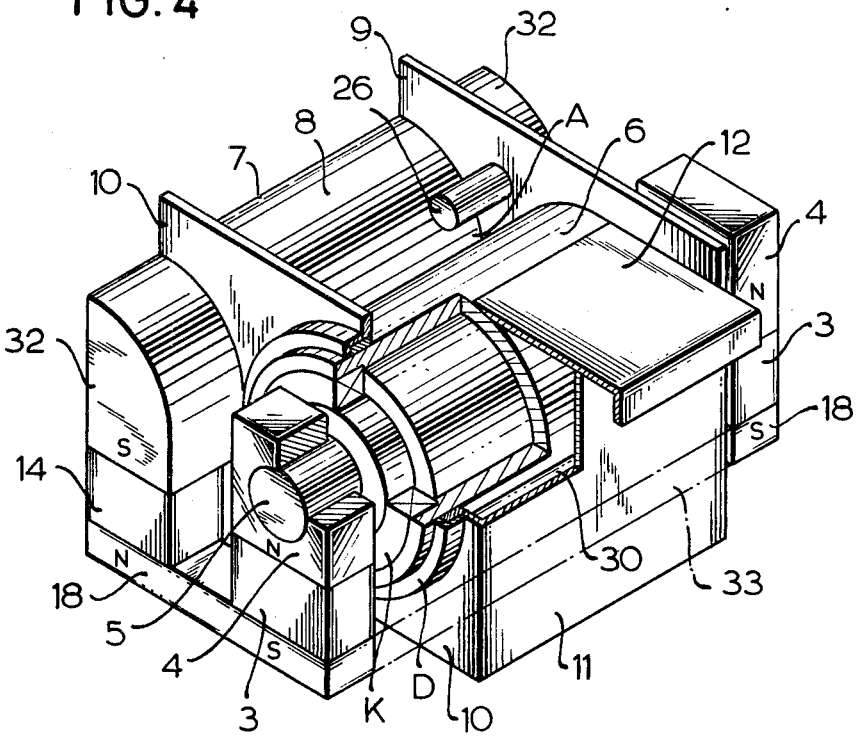
FIG. 4 is a perspective view, partly in section, of a magnetic separator generally similar to that of FIG. 1, but with a modified number of magnets in the magnetic system.

FIG. 4 likewise shows a magnetic separator with a separation roll 6 and a bridge 7 as an antipole, but with the difference that, in place of the angle irons 1,2, plates 18, conducting the magnetism, are provided, an additional permanent magnet 14 being arranged adjacent the permanent magnets 3 with pole shoes 4 on said plates with opposite directions of magnetization. The permanent magnets 14 bear the pole shoes 32. As in the case of the angle irons 1,2, they are interconnected by the bridge 7. The plate 18 acts as a magnetic short circuit plate, by interconnecting on the one hand the unequal poles of the permanent magnets 3,14. The presence of the permanent magnets 14 has no effect proper on the described entirely closed magnetic circuit, but serves simply to amplify the magnetic force of the magnetic separator, depending on the requirements to be met by the magnetic forces involved in the separation.

FIG. 5 shows another embodiment of a magnetic separator according to the invention where, instead of the separation roll 6 and a bridge 7, two separation rolls are employed. In this embodiment, the bridge 7 has been replaced by the separation roll 16 with the shaft 22 whereby the magnetic system also has on each side of the flow-through housing two permanent magnets 3,17, likewise arranged on a common base plate 18 of iron material conducting the magnetism, and equipped on the opposite pole side with the pole shoes 4,20. Using a corresponding design of the flow-through housing 9,10,11, which in this case is not a vat 8, the material to be separated enters the flow-through housing 9,10,11 at the inlet port 19. The non-magnetic material leaves the flow-through housing 9,10,11 at the discharge port 31. The separation rolls 6, 16 which may have solid shafts 5,22 (see FIG. 7) or segments (see FIG. 6) as shafts, about which in a manner known from the prior art the drum-shaped separation rolls 6,16, made from magnetic or non-magnetic material or alternately from both materials, rotate in the directions of the arrows, also separate the collected magnetic material via strippers 12. In FIG. 8, distribution bodies 21 are provided in relation to the separation rolls 6,16 which are placed opposite each other with likewise segment-shaped shafts 5,22 of 180° gap A in a precise manner, and located in the flow-through housing 9,10,11. They separate the magnetic material, which drops down directly through the gap A, from the magnetic material which is conveyed by the separation rolls 6,16 out of the magnetic zone where it drops off from the separation rolls 6,16, where the segments of the shafts 5,22 are no longer magnetically effective. Then the magnetic material leaves the flow-through housing 9,10,11 through the openings 15. The shafts 5,22 are adjustable in their bearings from the outside, and so are thus their segments within the area of the gap A.

Figure 9:
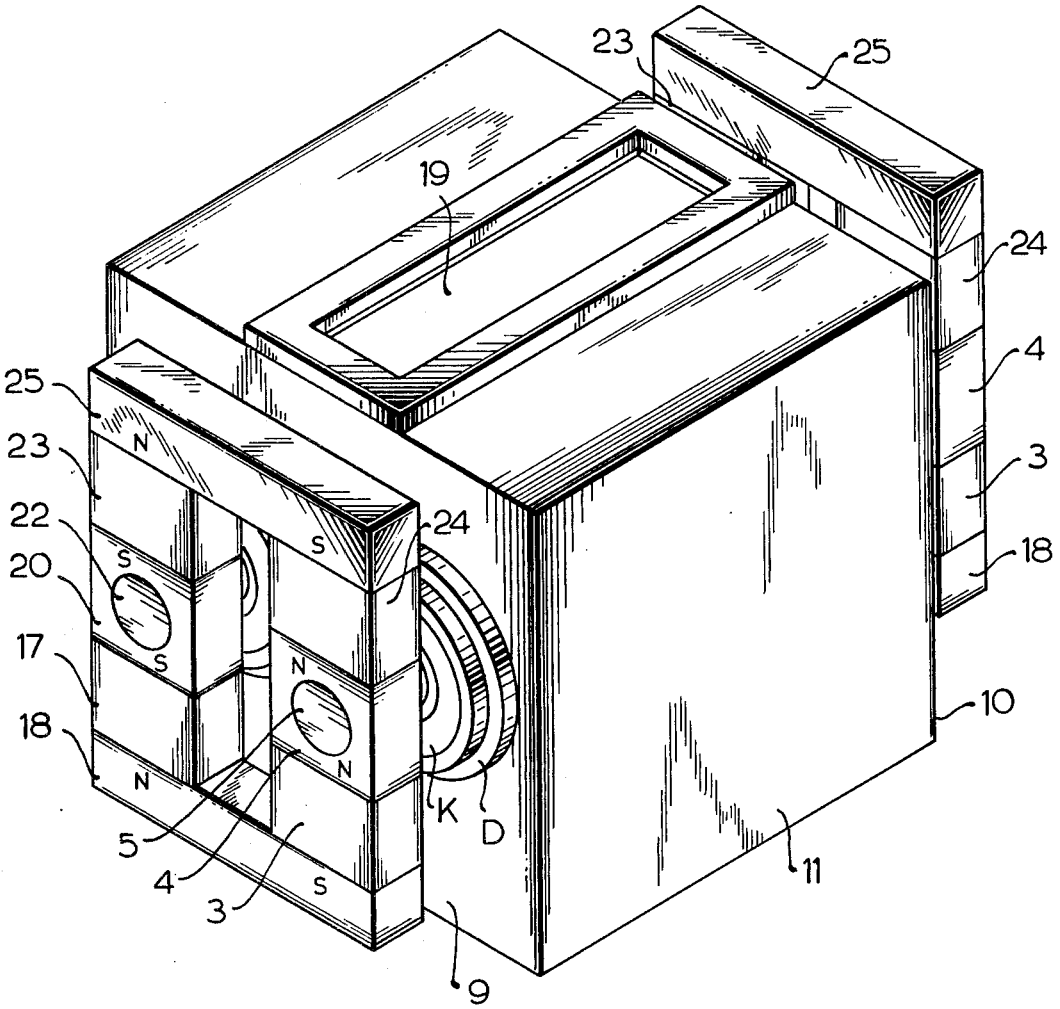
FIG. 9 is a perspective view of the magnetic separator generally according to FIG. 5, but utilizing a further modified embodiment of the magnet system.

Finally, for the amplification of the magnetic system of the magnetic separator a modification can be utilized whereby additional permanent magnets 23,24 are associated on both sides of the flow-through housing on the pole shoes 20,4 (see FIG. 9) in a direction of magnetization opposite to the permanent magnets 3,17, so that the pole shoes 20,4 in each case receive a double polarization from two identical magnetic poles. The additional permanent magnets 23,24 also are covered by an iron plate 25 conducting the magnetism. Then the magnetic system comprises two frame-like individual systems. Each individual system has an individually closed magnetic circuit which is connected via the shafts 22,5 or the bridge 7 and the shaft 5 to form a double magnetic system and accordingly amplify the magnetic field in the gap A to an even larger extent.

The separation roll 6 and/or the separation rolls 6,16 are propelled by a conventional drive means (not shown), which may, for instance, comprise a motor and conventional gearing.

The plates 18 located on both sides of the flow-through housing 9,10,11 also may be connected between each other in a magnetically conductive manner without thereby changing the prevailing directions of magnetization and/or causing deviations in the course of the magnetic lines of force. Such a connecting plate 33, as indicated by dots and dashes in FIG. 4, may be provided below the flow-through housing 9,10,11.

A switch 26 is used for controlling the prevailing height of the level of the material to be separated, insofar as it is liquid. It is actuated by contact with liquid, whereby the separation roll 6 or the separation rolls 6,16 will be put into rotation until the passage cross-section in the flow-through housing 9,10,11 again has enlarged due to the discharge of the collected parts, and the fluid level again has dropped below the switch 26. Such switch control means is, per se, broadly known in the art, and no patentable novelty is broadly claimed in its usage.

It is apparent that the magnetic separator described herein may undergo various modifications with reference to the magnetic system according to the invention and the flow-through housing, including, for example, modifications in the dimensions, shapes and cross-sections, as well as in the sizes and number of the magnets, without in any way departing from the novel principles and teachings disclosed herein, which involve, among other things, providing a closed magnetic circuit with an operating air gap formed therein from mild iron parts (separation roll and antipole) which form the basis for the various embodiments of the invention disclosed herein. It will also be understood that it is within the purview of the present invention to utilize electromagnets in place of permanent magnets.

I claim:

1. A magnetic separator for the cleaning of liquid, pasty and dry material, comprising means providing a flow-through housing with at least one separation roll arranged therein which magnetically cooperates with an antipole, characterized by the fact that said separation roll, including a shaft on which it is mounted for rotation, and said antipole are induced poles and comprise mild iron parts of at least one magnetic system with a closed magnetic circuit, the magnets of said magnetic system being positioned outside of the flow-through housing.

2. The magnetic separator as defined in claim 1, in which the magnetic system comprises two rectangular angle irons spaced from each other at the opposite sides of the flow-through housing.

3. The magnetic separator as defined in claim 2, in which said shaft and the antipole conduct the magnetism, and wherein said shaft and antipole interconnect the angle irons over such a distance that the space therebetween accommodates a flow-through housing of non-magnetic material.

4. The magnetic separator as defined in claim 1, in which the antipole is formed by a separate separation roll mounted on a separate shaft.

5. The magnetic separator as defined in claim 1, in which the magnetic system comprises plates for conducting the magnetism.

6. The magnetic separator as defined in claim 5, which includes, supported on said plates, permanent magnets and pole shoes and additional permanent magnets and pole shoes having opposite directions of magnetism, whereby said plates short the first-mentioned permanent magnets magnetically on one pole side, while, on the other pole side of the shaft, the opposite pole shoes and a bridge interconnect the first-mentioned pole shoes to form a closed magnetic system.

7. The magnetic separator as defined in claim 1, which includes two magnetic systems each containing a closed magnetic circuit and interconnected by the shaft of the separation roll and the antipole.

8. The magnetic separator as defined in claim 7, which includes plates located on both sides of the flow-through housing, said plates being interconnected by bodies conductive for the magnetism.

9. The magnetic separator as defined in claim 1, wherein the magnetic system comprises frame-like individual magnet systems formed by four permanent magnets which are interconnected in pairs by pole shoes and connected among each other at their opposite poles by plates, whereby each pair of permanent magnets is in contact with identical poles to a pair of pole shoes and wherein said pole shoes have a different polarity among each other, said frame-like individual magnet systems being connected by the shafts positioned in the pole shoes into a double magnetic system.

10. The magnetic separator as defined in claim 1, wherein there are two separation rolls which alternately consist of magnetically conductive and of magnetically non-conductive material.

11. The magnetic separator as defined in claim 1, in which there are two shafts spaced from each other, and on each of which shafts a separation solid roll is mounted, said rolls being spaced from each other.

12. The magnetic separator as defined in claim 11, wherein the shafts on which the separation rolls are supported are of segmental shape.

* * * * *